US009020395B2

(12) United States Patent
Handa et al.

(10) Patent No.: US 9,020,395 B2
(45) **Date of Patent: *Apr. 28, 2015**

(54) DEVELOPING CARTRIDGE AND PROCESS CARTRIDGE FOR STABLY ROTATING DEVELOPING ROLLER

(71) Applicant: Brother Kogyo Kabushiki Kaisha, Nagoya-shi, Aichi-ken (JP)

(72) Inventors: Hiroshi Handa, Aisai (JP); Hiroki Mori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/220,538

(22) Filed: Mar. 20, 2014

(65) Prior Publication Data

US 2014/0294450 A1 Oct. 2, 2014

Related U.S. Application Data

(63) Continuation of application No. 13/052,907, filed on Mar. 21, 2011, now Pat. No. 8,682,216.

(30) Foreign Application Priority Data

Mar. 24, 2010 (JP) ..... 2010-068577

(51) Int. Cl.

| | |
|---|---|
| ***G03G 15/08*** | (2006.01) |
| ***G03G 21/18*** | (2006.01) |
| *G03G 21/16* | (2006.01) |

(52) U.S. Cl.

CPC ..... *G03G 15/0808* (2013.01); *G03G 21/1821* (2013.01); *G03G 15/0806* (2013.01); *G03G 21/1676* (2013.01); *G03G 2221/163* (2013.01); *G03G 15/0865* (2013.01)

(58) Field of Classification Search

USPC ..... 399/119, 265, 267, 272, 279, 281

IPC ..... G03G 15/0808,15/0806, 15/0865, 21/1821, G03G 21/1676, 2221/163

See application file for complete search history.

(56) References Cited

U.S. PATENT DOCUMENTS

| | | | |
|---|---|---|---|
| 4,373,468 | A | 2/1983 | Suda et al. |
| 4,992,767 | A | 2/1991 | Hozumi et al. |

(Continued)

FOREIGN PATENT DOCUMENTS

| | | | |
|---|---|---|---|
| JP | H01-100150 | U | 7/1989 |
| JP | 10-301392 | A | 11/1998 |

(Continued)

OTHER PUBLICATIONS

Japan Patent Office, Notification of Reasons for Refusal for Japanese Patent Application No. 2010-068577 (counterpart Japanese Patent Application), dispatched Jul. 17, 2012.

*Primary Examiner* — Robert Beatty

(74) *Attorney, Agent, or Firm* — Banner & Witcoff, Ltd.

(57) ABSTRACT

A developing cartridge includes: a developing roller main body; a developing roller shaft, which is arranged along a central axis line of the developing roller main body, and which protrudes from both end portions of the developing roller main body along the central axis line, wherein the developing roller shaft includes a small diameter part located at a first end portion in the axis line direction, the small diameter part having an outer diameter smaller than an outer diameter of a second end portion opposite to the first end portion; and a developing gear that is fixed to the first end portion of the developing roller shaft.

17 Claims, 11 Drawing Sheets

(56) References Cited

U.S. PATENT DOCUMENTS

| | | | |
|---|---|---|---|
| 5,583,473 | A | 12/1996 | Yamashita |
| 6,317,575 | B1 | 11/2001 | Kumar et al. |
| 6,816,692 | B1 | 11/2004 | Kerley et al. |
| 7,043,180 | B2 | 5/2006 | Askren et al. |
| 7,450,876 | B2 | 11/2008 | Ishii et al. |
| 7,620,347 | B2 | 11/2009 | Okabe |
| 7,643,774 | B2 | 1/2010 | Choi |
| 7,693,442 | B2 | 4/2010 | Sato et al. |
| 2005/0201772 | A1 | 9/2005 | Ishii et al. |
| 2006/0029418 | A1 | 2/2006 | Ishii et al. |
| 2006/0029419 | A1 | 2/2006 | Shiraki |
| 2006/0029420 | A1 | 2/2006 | Ishii et al. |
| 2006/0029421 | A1 | 2/2006 | Ishii et al. |
| 2006/0029422 | A1 | 2/2006 | Shiraki |
| 2006/0029423 | A1 | 2/2006 | Shiraki |
| 2007/0009281 | A1 | 1/2007 | Sato et al. |
| 2007/0009282 | A1 | 1/2007 | Sato et al. |

FOREIGN PATENT DOCUMENTS

| | | | |
|---|---|---|---|
| JP | 2005-258344 | A | 9/2005 |
| JP | 2006-184501 | A | 7/2006 |
| JP | 2007-102152 | A | 4/2007 |
| JP | 2007-304237 | A | 11/2007 |
| JP | 2009-048219 | A | 3/2009 |
| JP | 2009-251541 | A | 10/2009 |

DEVELOPING CARTRIDGE AND PROCESS CARTRIDGE FOR STABLY ROTATING DEVELOPING ROLLER

CROSS-REFERENCE TO RELATED APPLICATIONS

This application is a continuation of U.S. patent application Ser. No. 13/052,907, filed on Mar. 21, 2011, which claims priority from Japanese Patent Application No. 2010-068577 filed on Mar. 24, 2010, the disclosures of which are incorporated herein by reference in their entirety.

TECHNICAL FIELD

The present invention relates to a process cartridge that is detachably mounted to a main body of an image forming apparatus and a developing cartridge that is provided to the process cartridge.

BACKGROUND

In an image forming apparatus such as a laser printer, there has been proposed a process cartridge that is detachably mounted to a main body of the apparatus.

The process cartridge includes a drum cartridge having a photosensitive drum and a developing cartridge that is detachably mounted to the drum cartridge and that has a developing roller.

A shaft of the developing roller (developing roller shaft) is rotatably supported by a developing frame that forms a housing for the developing cartridge. In addition, both end portions of the developing roller shaft protrude outwardly from the developing frame. A developing roller driving gear is attached to a part, of one end portion of the developing roller shaft, which protrudes from the developing frame.

When the developing cartridge is mounted to the drum cartridge and a circumferential surface of the developing roller contacts a circumferential surface of the photosensitive drum the developing roller is rotated via the developing roller shaft when driving force is input to the developing roller driving gear. Thereby, developer is supplied from the circumferential surface of the developing roller to the circumferential surface of the photosensitive drum.

SUMMARY

Illustrative aspects of exemplary embodiments of the invention may a developing cartridge capable of enabling a developing roller to stably rotate over an axis line direction thereof and a process cartridge having the developing cartridge.

DETAILED DESCRIPTION

General Overview

Figure 1:
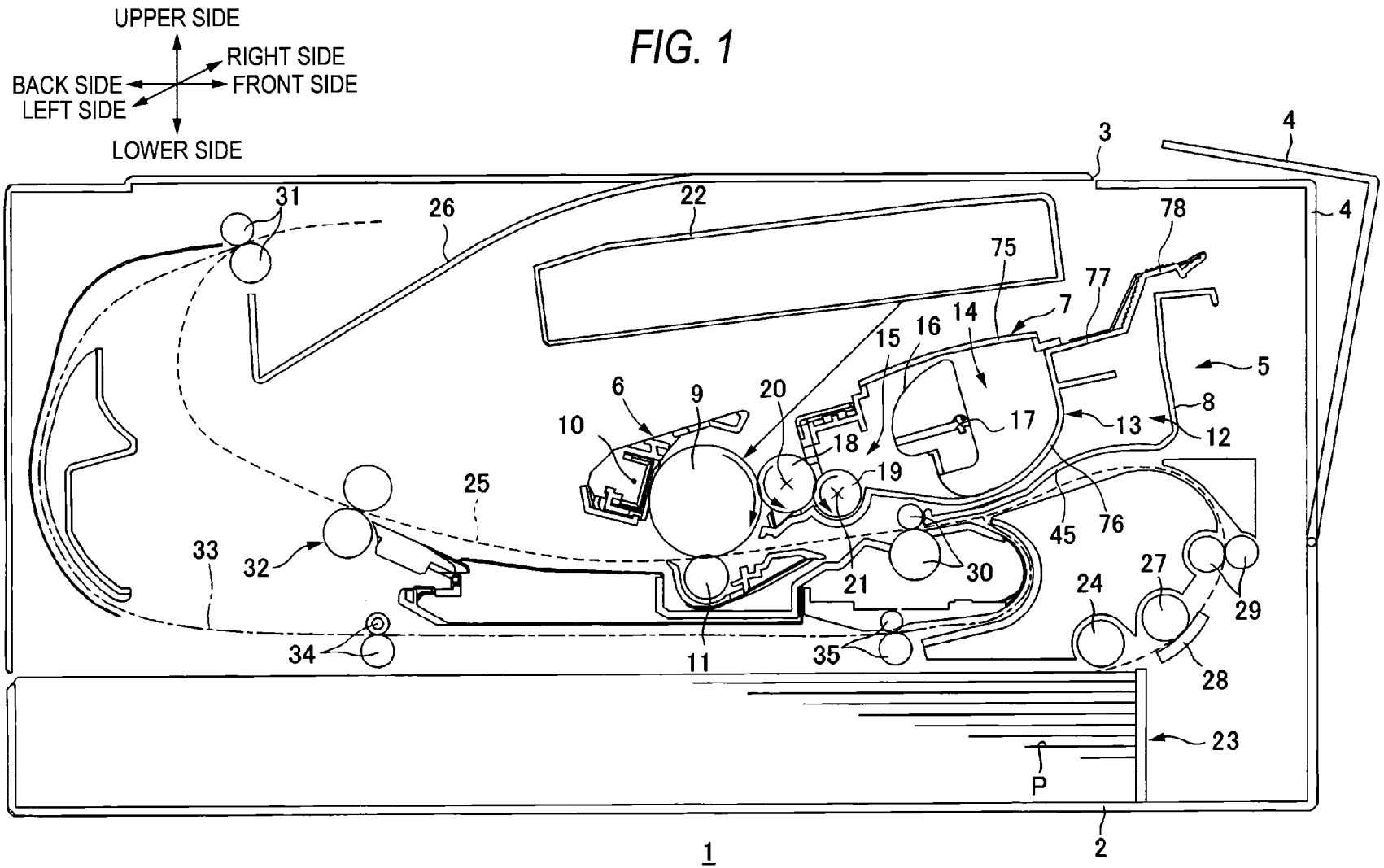
FIG. 1 is a sectional view of a laser printer to which a process cartridge according to an illustrative embodiment of the invention is mounted.

In the above-described related-art process cartridge, the one end portion of the developing roller shaft protrudes from the developing frame more than the other end portion for the purpose of attaching the developing roller driving gear thereto. Further, a weight of the developing roller driving gear is added to the one end portion of the developing roller shaft. As a result, the center of the developing roller shaft is inclined toward the one end portion of the developing roller shaft with respect to an axially central portion of a contact part between the developing roller and the photosensitive drum. When the driving force is input to the developing roller shaft under such a state, the rotation of the developing roller is axially shaken. As a result, the developer may not be favorably supplied from the developing roller to the photosensitive drum.

Therefore, illustrative aspects of the invention provide a developing cartridge capable of enabling a developing roller to stably rotate over an axis line direction thereof and a process cartridge having the developing cartridge.

According to one aspect of the invention, there is provided a developing cartridge comprising: a developing roller main body; a developing roller shaft, which is arranged along a central axis line of the developing roller main body, and which protrudes from both end portions of the developing roller main body along the central axis line, wherein the developing roller shaft comprises a small diameter part located at a first end portion in the axis line direction, the small diameter part having an outer diameter smaller than an outer diameter of a second end portion opposite to the first end portion; and a developing gear that is fixed to the first end portion of the developing roller shaft.

According to another aspect of the invention, there is provided a process cartridge comprising: a drum cartridge that holds a photosensitive drum; and the developing cartridge detachably mounted to the drum cartridge.

According to the illustrative aspects of the invention, the developing roller shaft is arranged along the central axis line of the developing roller main body and protrudes from both end portions of the axis line direction of the developing roller main body. The first end portion of the developing roller shaft, which is located at one side of the axis line direction, has a small diameter part having an outer diameter that is smaller than the second end portion of the opposite side. In addition, the developing gear is attached to the first end portion so that the developing gear cannot be relatively rotated.

Since the developing gear is fixed to the first end portion of the developing roller shaft, the weight of the developing gear is added to the first end portion. However, the first end portion has a small diameter part so that the increase in weight due to the fixing of the developing gear can be offset. Accordingly, it is possible to prevent the center of the developing roller shaft from being inclined toward the first end portion due to the increase in weight resulting from the fixing of the developing gear. As a result, it is possible to stably rotate the developing roller over the axis line direction thereof.

Exemplary Embodiments

Hereinafter, exemplary embodiments of the invention will be specifically described with reference to the drawings.

(Printer)

As shown in FIG. 1, a laser printer 1 (one example of an image forming apparatus) has a body casing 2 (one example of a main body). One sidewall of the body casing 2 is formed with a cartridge attaching and detaching port 3 and is provided with a front cover 4 that opens and closes the cartridge attaching and detaching port 3.

In the following descriptions, a side at which the front cover 4 is provided is referred to as a front side. The upper, lower, left and right of the laser printer 1 are set when seen from the front side of the laser printer 1. In addition, regarding a developing cartridge 7 (which will be described later), the front and back are set based on a state in which the developing cartridge is mounted to the body casing 2. Further, the upper, lower, left and right of the developing cartridge 7 are set when seen from the front side of the developing cartridge 7.

A process cartridge 5 is mounted at a slightly more forward position than a center in the body casing 2. The process cartridge 5 is mounted into the body casing 2 and detached from the body casing through the cartridge attaching and detaching port 3 when the front cover 4 is opened.

The process cartridge 5 includes a drum cartridge 6 and a developing cartridge 7. The developing cartridge 7 is detachably mounted to the drum cartridge 6.

The drum cartridge 6 has a drum frame 8. A photosensitive drum 9 is rotatably held at a rear end portion of the drum frame 8. In addition, the drum frame 8 holds a charger 10 and a transfer roller 11. The charger 10 and the transfer roller 11 are arranged at front and lower sides of the photosensitive drum 9, respectively.

A more forward part of the drum frame 8 than the photosensitive drum 9 is a developing cartridge mounting part 12. The developing cartridge 7 is mounted to the developing cartridge mounting part 12.

The developing cartridge 7 has a housing 13 that accommodates toner. In the housing 13, a toner accommodating chamber 14 and a developing chamber 15, which communicate with each other, are formed to be adjacent forward and backward.

The toner accommodating chamber 14 is provided therein with an agitator 16 so that the agitator 16 can be rotated about an agitator rotational shaft 17. The agitator rotational shaft 17 extends leftward and rightward. When the agitator 16 is rotated, the toner accommodated in the toner accommodating chamber 14 is supplied to the developing chamber 15 from the toner accommodating chamber 14 while being stirred.

The developing chamber 15 is provided therein with a developing roller 18 and a supply roller 19 so that the developing roller 18 and the supply roller 19 can be rotated about a developing rotational axis line 20 and a supply rotational axis line 21 extending leftward and rightward, respectively. The developing roller 18 is arranged so that a part of a circumferential surface thereof is exposed from a rear end portion of the housing 13. The developing cartridge 7 is mounted to the drum cartridge 31 so that the circumferential surface of the developing roller 18 contacts a circumferential surface of the photosensitive drum 9. The supply roller 19 is arranged so that a circumferential surface thereof contacts the circumferential surface of the developing roller 18 from a front-lower side. The toner in the developing chamber 15 is supplied to the circumferential surface of the developing roller 18 by the supply roller 19 and is carried as a thin layer on the circumferential surface of the developing roller 18.

In the body casing 2, an exposure device 22 that emits a laser and the like is arranged above the process cartridge 5.

When forming an image, the photosensitive drum 9 is rotated at a constant speed in a clockwise direction of FIG. 1. As the photosensitive drum 9 is rotated, the circumferential surface of the photosensitive drum 9 is uniformly charged by discharge from the charger 10. In the meantime, based on image data received from a personal computer (not shown) connected to the printer 1, a laser beam is emitted from the exposure device 22. The laser beam passes between the charger 10 and the developing cartridge 7 and irradiates the circumferential surface of the photosensitive drum 9 that is positively charged, thereby selectively exposing the circumferential surface of the photosensitive drum 9. Thus, charges are selectively removed from the exposed part of the photosensitive drum 9, so that an electrostatic latent image is formed on the circumferential surface of the photosensitive drum 9. When the electrostatic latent image faces the developing roller 18 as the photosensitive drum 9 is rotated, the toner is supplied to the electrostatic latent image from the developing roller 18. Thereby, a toner image is formed on the circumferential surface of the photosensitive drum 9.

A sheet feeding tray 23 that stacks sheets P therein is arranged on a bottom part of the body casing 2. A pickup roller 24 for sending the sheets from the sheet feeding tray 23 is provided above the sheet feeding tray 23.

Additionally, a conveyance path 25, which has an S shape when seen from the side face, is formed in the body casing 2. The conveyance path 25 reaches a sheet discharge tray 26 formed at an upper surface of the body casing 2 via a space between the photosensitive drum 9 and the transfer roller 11 from the sheet feeding tray 23. A separation roller 27 and a separation pad 28, which are arranged to be opposite to each other, a pair of feeder rollers 29, a pair of register rollers 30 and a pair of sheet discharge rollers 31 are provided on the conveyance path 25.

The sheets P sent from the sheet feeding tray 23 are separated one at a time while passing between the separation roller 27 and the separation pad 28. Then, the sheet P is conveyed toward the register rollers 30 by the feeder rollers 29. Then, the sheet P is registered by the register rollers 30 and then conveyed between the photosensitive drum 9 and the transfer roller 11 by the register rollers 30.

The toner image on the circumferential surface of the photosensitive drum 9 is electrically attracted and transferred on the sheet P by the transfer roller 11 when the toner image faces the sheet P passing between the photosensitive drum 9 and the transfer roller 11 by the rotation of the photosensitive drum 9.

On the conveyance path 25, a fixing device 32 is provided at a downstream side of the conveyance direction of the sheet P regarding the transfer roller 11. The sheet P, on which the toner image is transferred, is conveyed through the conveyance path 25 and passes through the fixing device 32. In the fixing device 32, the toner image becomes an image that is then fixed on the sheet P by heating and pressing.

The printer 1 has a one-sided mode of forming an image (toner image) on one side of the sheet P and a duplex mode of forming an image on one side of the sheet P and then forming an image on the other side of the sheet P, as operation modes.

In the one-sided mode, the sheet P having an image formed on one side thereof is discharged to the sheet discharge tray 26 by the sheet discharge rollers 31.

As a configuration for realizing the duplex mode, the body casing 2 includes a reverse conveyance path 33. The reverse conveyance path 33 extends between the conveyance path 25 and the sheet feeding tray 23 from the vicinity of the sheet discharge rollers 31 and is connected to a part between the feeder rollers 29 and the register rollers 30 on the conveyance path 25. A pair of first reverse conveyance rollers 34 and a pair of second reverse conveyance rollers 25 are provided on the reverse conveyance path 33.

In the duplex mode, the sheet P having an image formed on one side thereof is sent to the reverse conveyance path 33 without being discharged to the sheet discharge tray 26. Then, the sheet P is conveyed through the reverse conveyance path 33 by the first reverse conveyance rollers 34 and the second reverse conveyance rollers 35 and two sides of the sheet are reversed, so that the other side having no image formed thereon is sent to the conveyance path 25 facing the circumferential surface of the photosensitive drum 9. Then, an image is formed on the other side of the sheet P, so that the images are formed on both sides of the sheet P.

(Process Cartridge)

(1) Drum Cartridge (1-1) Drum Frame

Figure 2:
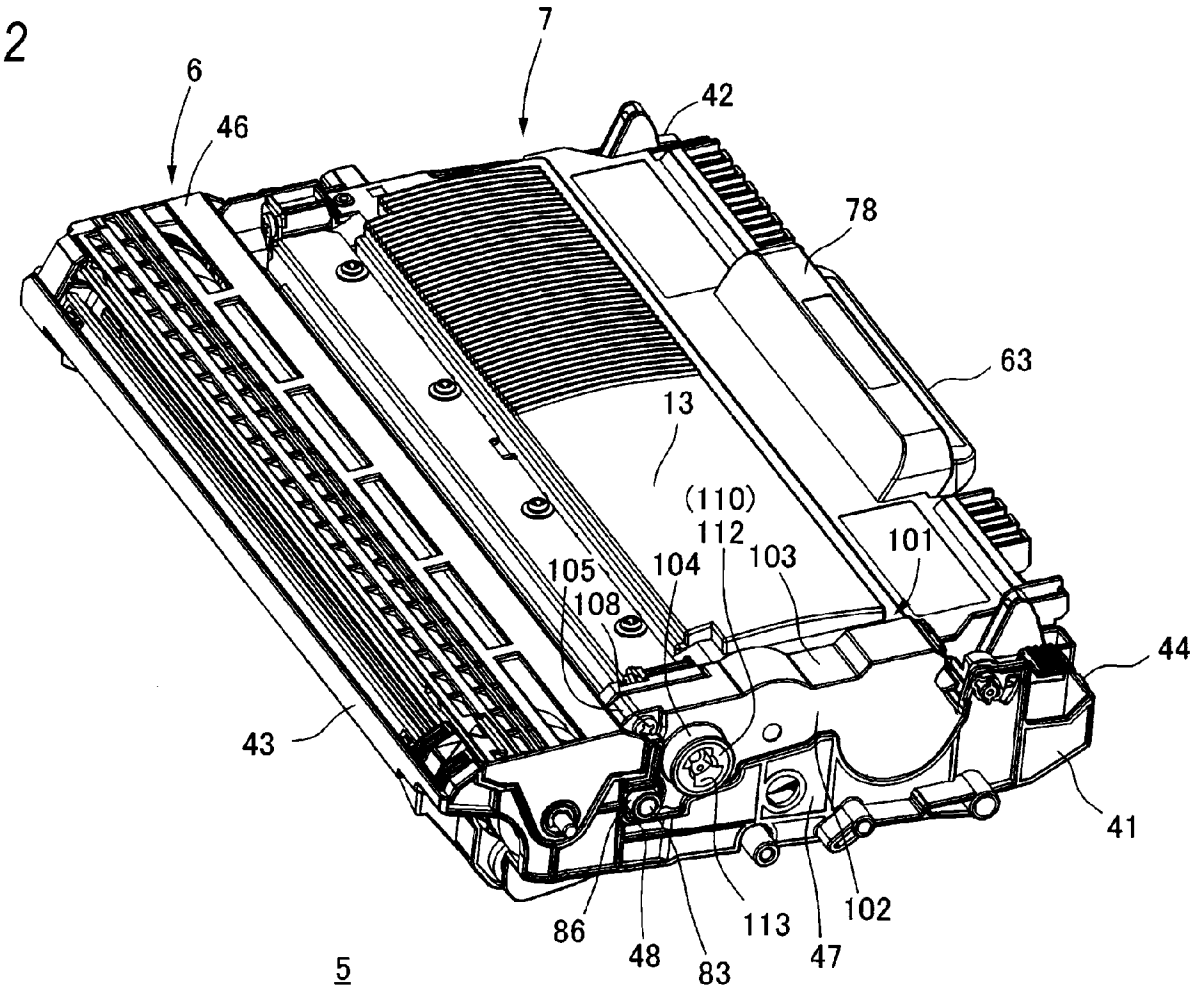
FIG. 2 is a perspective view of a process cartridge shown in FIG. 1, which is seen from a left, back and upper direction.

As shown in FIG. 2, the drum frame 8 of the drum cartridge 6 has a left sidewall 41 and a right sidewall 42. The left sidewall 41 and the right sidewall 42 have an elongated plate shape extending in the front-rear direction and face each other at an interval in the left-right direction. A back side wall 43 is bridged between respective rear end portions of the left sidewall 41 and the right sidewall 42. A front side wall 44 is bridged between respective front end portions of the left sidewall 41 and the right sidewall 42. As shown in FIG. 1, a bottom wall 45 is bridged between respective lower end portions of the left sidewall 41 and the right sidewall 42 so as to block the lower part thereof. Thereby, the drum frame 8 has a quadrangular frame shape having a closed bottom when seen from a plan view.

As shown in FIG. 2, an upper side wall 46 is bridged between the respective rear end portions of the left sidewall 41 and the right sidewall 42 so as to cover the upper side wall from above. The photosensitive drum 9 and the transfer roller 11 are rotatably supported by the left sidewall 41 and the right sidewall 42 between the upper side wall 46 and the bottom wall 43. In addition, the charger 10 (refer to FIG. 1) is provided between the respective rear end portions of the left sidewall 41 and the right sidewall 42 to block a space between the rear side wall 43 and the upper side wall 46 at the rear part of the upper side wall 46.

In the space sandwiched between the left sidewall 41 and the right sidewall 42, a part that is not opposed to the upper side wall 46 and has an opened upper portion becomes the developing cartridge mounting part 12. When the developing cartridge 7 is mounted to the developing cartridge mounting part 12, parts (hereinafter, referred to as 'developing cartridge facing parts') 47 of the left sidewall 41 and the right sidewall 42, which face the developing cartridge mounting part 12, are arranged to face the developing cartridge 7 at a slight interval, respectively. In addition, an upper face of the upper side wall 46 is substantially flush with an upper face of the developing cartridge 7.

A back side upper end portion of each developing cartridge facing part 47 is formed with a roller shaft receiving part 48 (one example of a guidance part) having a substantially C shape having an opened front side.

(1-2) Drum Side Holding Part

As shown in FIG. 2, a central part of the left-right direction of the front side wall 44 of the drum frame 8 is provided with a drum side holding part 63. The drum side holding part 63 has a rectangular shape. The drum side holding part 63 is elongated in the left-right direction when seen from a plan view and is integrally formed with the front side wall 44.

(2) Developing Cartridge (2-1) Housing

Figure 3:
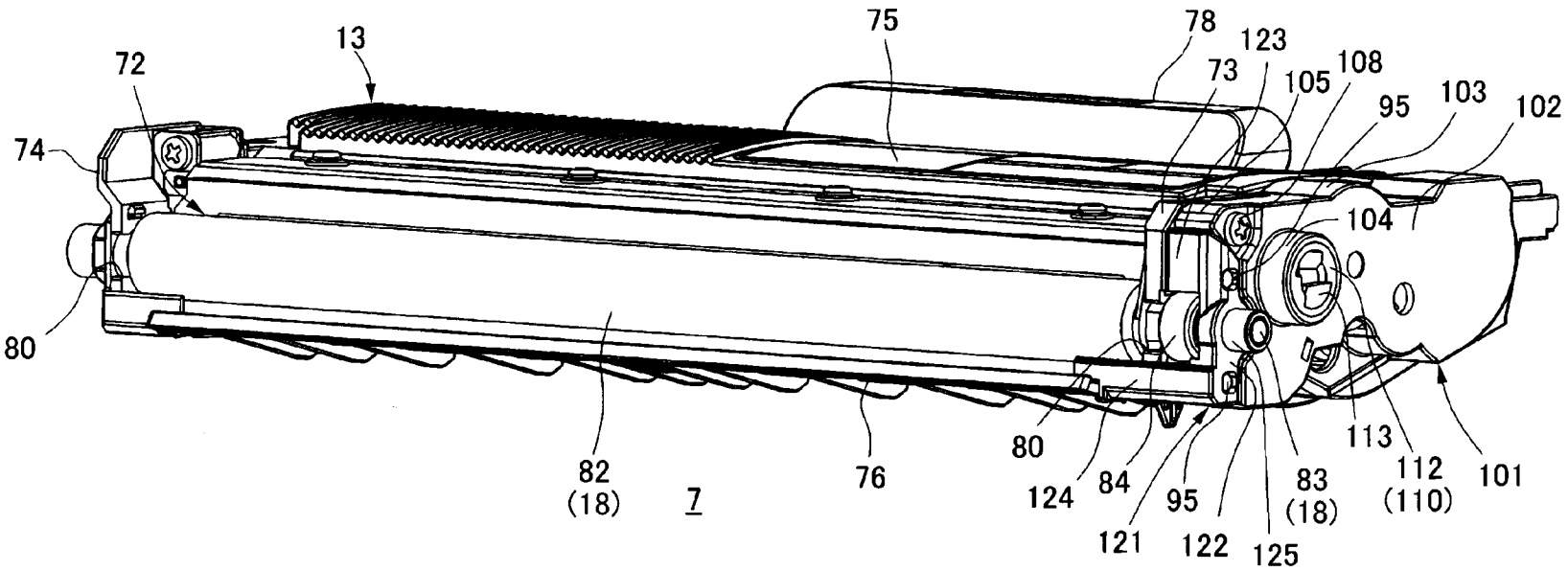
FIG. 3 is a perspective view of a developing cartridge shown in FIG. 2, which is seen from a left-back side.

As shown in FIG. 3, the housing 13 of the developing cartridge 7 has a box shape. The housing 13 is formed with an opening 72 that is opened rearward.

Specifically, the housing 13 has a left sidewall 73 and a right sidewall 74. The left sidewall 73 and the right sidewall 74 face each other in the left-right direction and have a plate shape that extends in the front-rear direction, respectively. In addition, the housing 13 has an upper side wall 75 that is bridged between respective upper end portions of the left sidewall 73 and the right sidewall 74 and a lower side wall 76 that is bridged between respective lower end portions of the left sidewall 73 and the right sidewall 74. As shown in FIG. 1, a front end portion of the lower side wall 76 extends upwardly with being curved and is bonded to a front end portion of the upper side wall 75.

Figure 5:
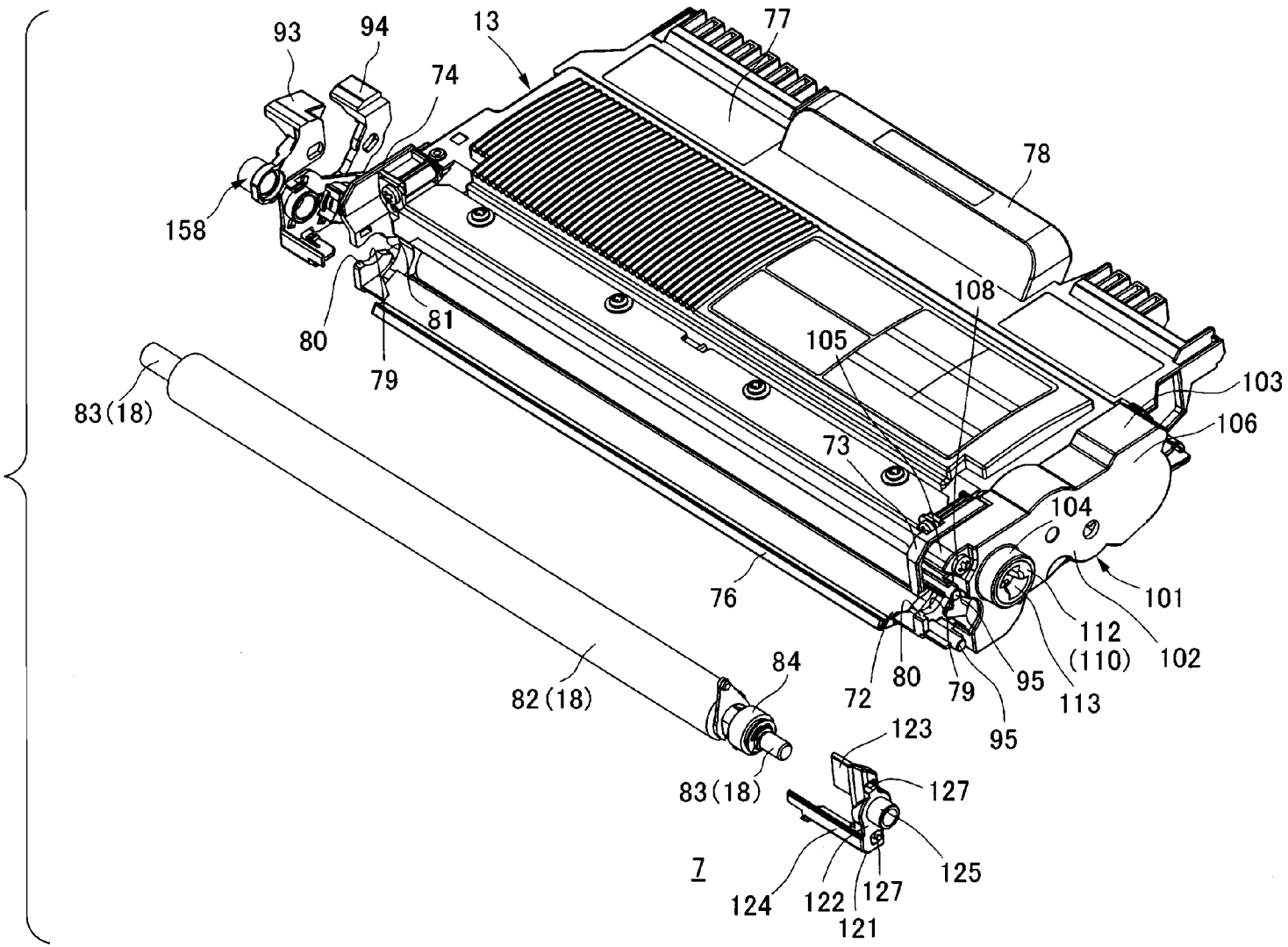
FIG. 5 is an exploded perspective view showing respective members of the developing cartridge shown in FIG. 2.

In addition, as shown in FIGS. 1, 2 and 5, the front end portion of the lower side wall 76 has an extension 77 that extends further forward from the portion bonded with the front end portion of the upper side wall 75. The extension 77 is formed at its central part of the left-right direction thereof with a developing side holding part 78. The developing side holding part 78 protrudes into a rectangular shape elongated in the left-right direction when seen from a plan view and has a substantially C shape having an opened lower side when seen from a front side.

Figure 12:
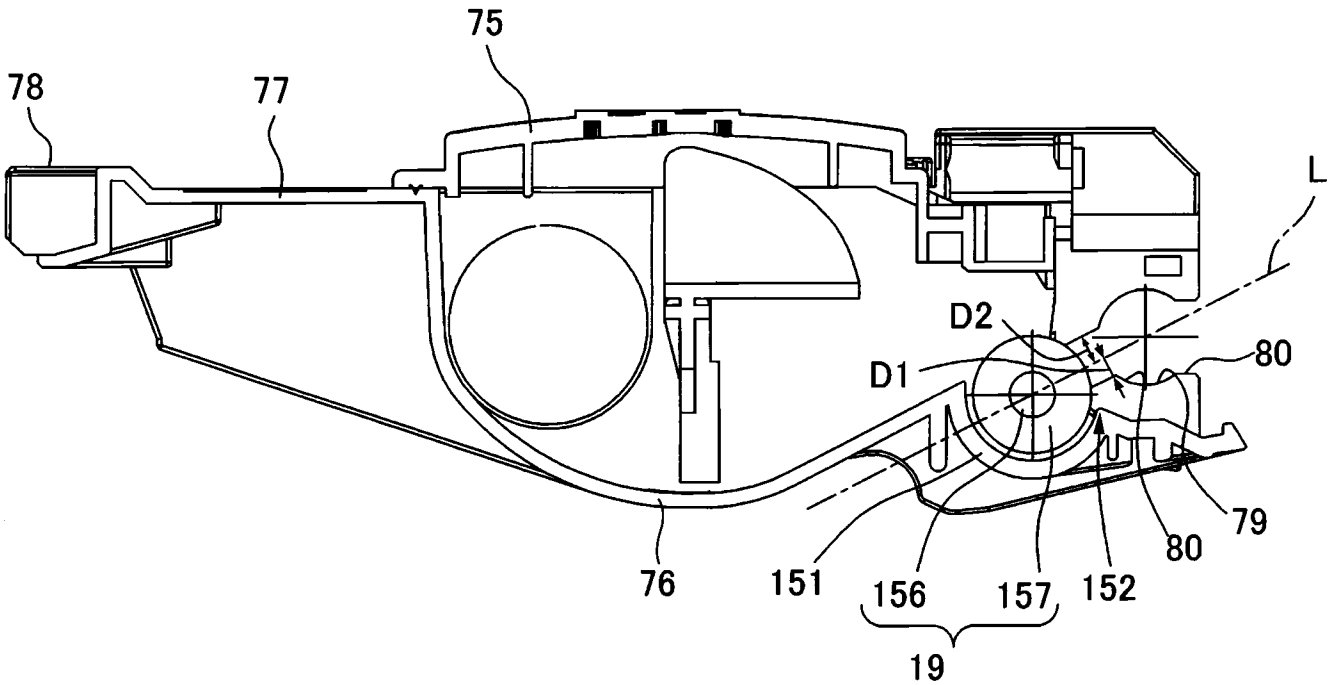
FIG. 12 is a side sectional view of the developing cartridge, when seen from an inside of the developing cartridge toward a left sidewall thereof.

Additionally, as shown in FIG. 12, the rear end portion of the lower side wall 76 is formed with an arc-shaped part 151 protruding downward, when seen from a side face. Further, the lower side wall 76 is bent in the rear-lower direction from a rear end portion of the arc-shaped part 151 and then extends more rearward. The arc-shaped part 151 is formed at its boundary portion (bent portion) between the rear end portion of the arc-shaped part and a rear part thereof with a ridge 152. The ridge 152 protrudes upwardly, extending in the left-right direction and has a substantially triangular shape when seen from a side face.

As shown in FIG. 5, the respective rear end portions of the left sidewall 73 and the right sidewall 74 are formed at positions facing each other in the left-right direction with first shaft insertion through-holes 79 having a circular shape, respectively. In addition, the left sidewall 73 and the right sidewall 74 are formed at rear positions of the first shaft insertion through-holes 79 with first penetrated shaft introducing parts 80 communicating with the first shaft insertion through-holes 79 and having a rectangular shape when seen from a side face. The first shaft introducing parts 80 are opened at respective rear end edges of the left sidewall 73 and the right sidewall 74.

Figure 11:
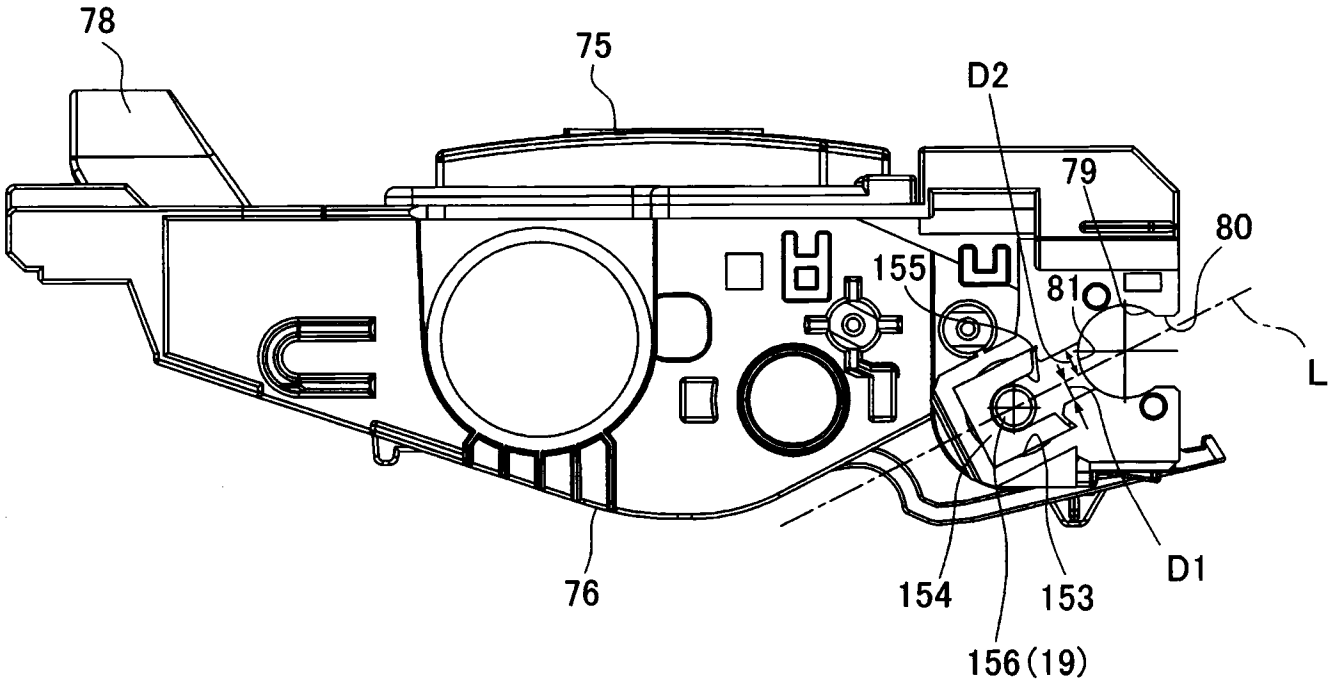
FIG. 11 is a right side view of the developing cartridge, showing a state in which a developing roller is separated from the developing cartridge.

Furthermore, as shown in FIG. 11, the left sidewall 73 and the right sidewall 74 are formed at front-lower sides of the first shaft insertion through-holes 79 with second shaft insertion through-holes 153 having a substantially rectangular shape when seen from a side face, respectively. The left sidewall 73 and the right sidewall 74 are also formed with second penetrated shaft introducing parts 81 (one example of passages) communicating the first shaft insertion through-holes 79 with the second shaft insertion through-holes 153.

A supply bearing member 154 is inserted into the second shaft insertion through-hole 153. The supply bearing member 154 has an outward shape that is substantially the same as the second shaft insertion through-hole 153 when seen from a side face and has a substantially U-shape that is opened toward the second shaft introducing part 81. The opened part 155 has substantially the same size as an outer diameter of the supply roller shaft 156 of the supply roller 19 in a direction perpendicular to the direction facing toward the second shaft introducing part 81.

In addition, the second shaft introducing part 81 is upwardly inclined with respect to a line L connecting a center of the first shaft insertion through-hole 79 and a center of the second shaft insertion through-hole 153. Specifically, regarding a direction orthogonal to the line L, a distance D1 between the line L and a part facing the second shaft introducing part 81 from below thereof at each of the sidewalls 73, 74 is smaller than a distance D2 between the line L and a part facing the second shaft introducing part 81 from the above thereof at each of the sidewalls 73, 74.

In addition, the left sidewall 73 is formed with thin cylindrical bosses 95, which protrude leftward, above and below the first shaft introducing part 80.

(2-2) Developing Roller

Figure 4:
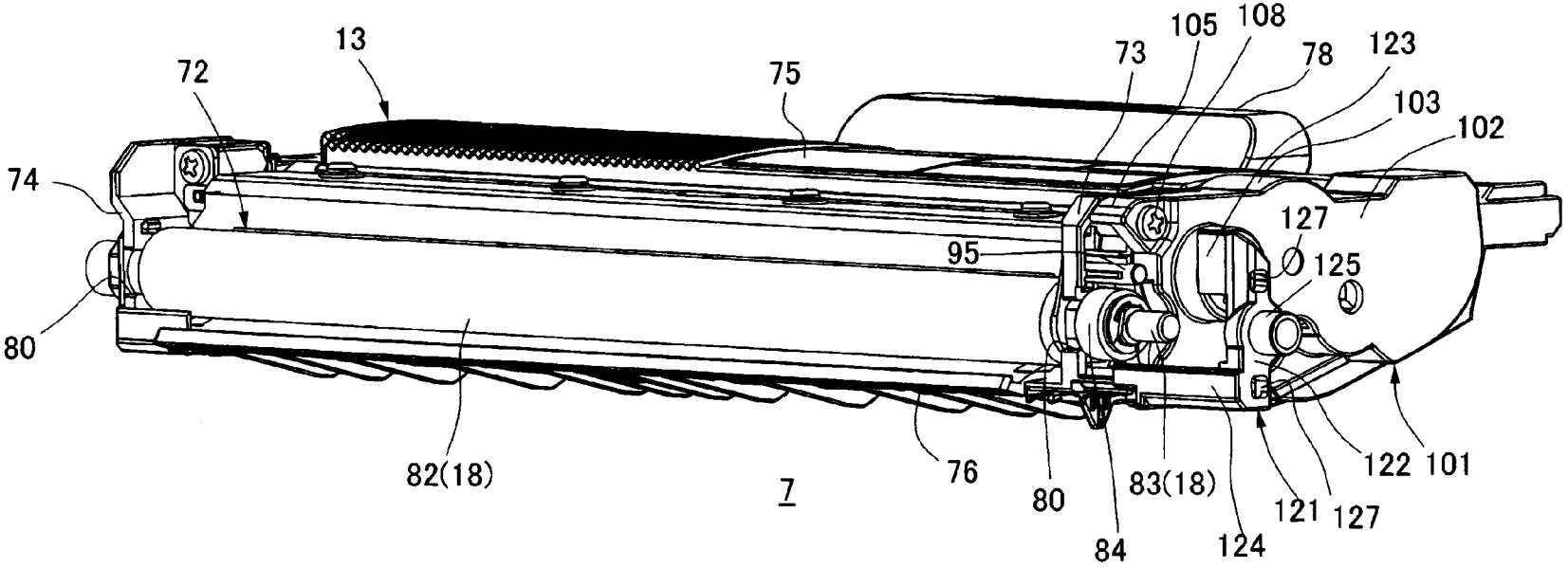
FIG. 4 is a perspective view of the developing cartridge shown in FIG. 2, which is seen from a left-back side, in which a second gear cover is separated.

The developing roller 18 has a cylindrical roller main body 82 having an axis line extending in the left-right direction as a center and a developing roller shaft 83 that is inserted into the roller main body 82 along the central axis line thereof. Both left and right end portions of the developing roller shaft 83 protrude from both left and right end faces of the roller main body 82, respectively. As shown in FIG. 4, the left end portion of the developing roller shaft 83 is rotatably inserted into the first shaft insertion through-hole 79 of the left sidewall 73 and protrudes outwardly from the left sidewall 73. In addition, the right end portion of the developing roller shaft 83 is rotatably inserted into the first shaft insertion through-hole 79 of the right sidewall 74 and protrudes outwardly from the right sidewall 74.

(2-3) Developing Roller Shaft

Figure 9:
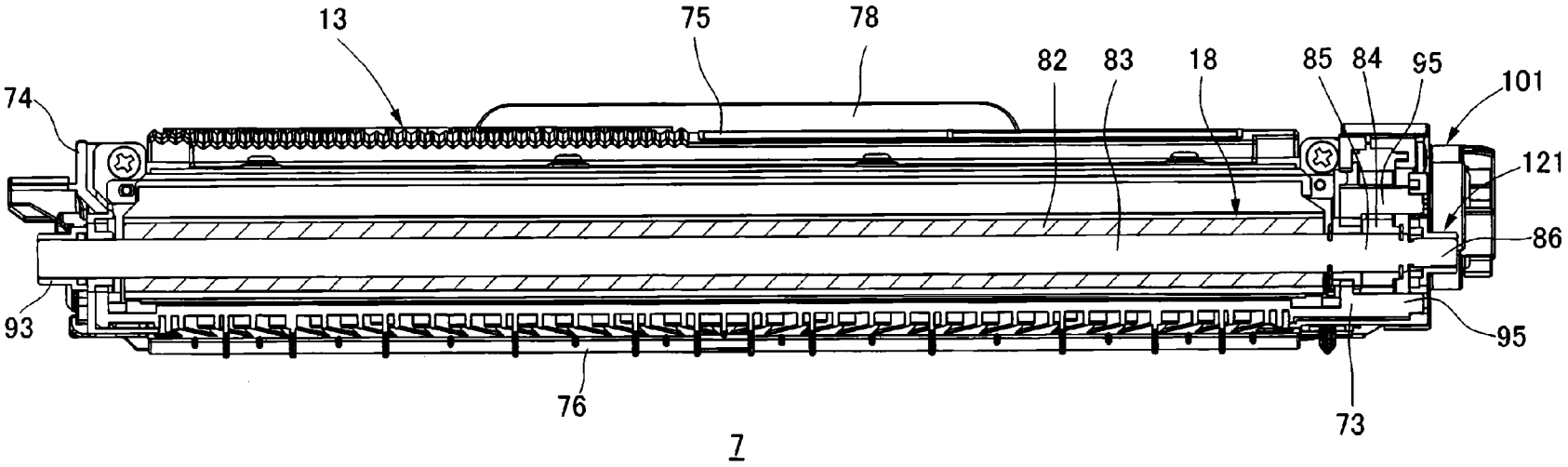
FIG. 9 is a sectional view of the developing cartridge taken along a line IX-IX shown in FIG. 8.
Figure 10:
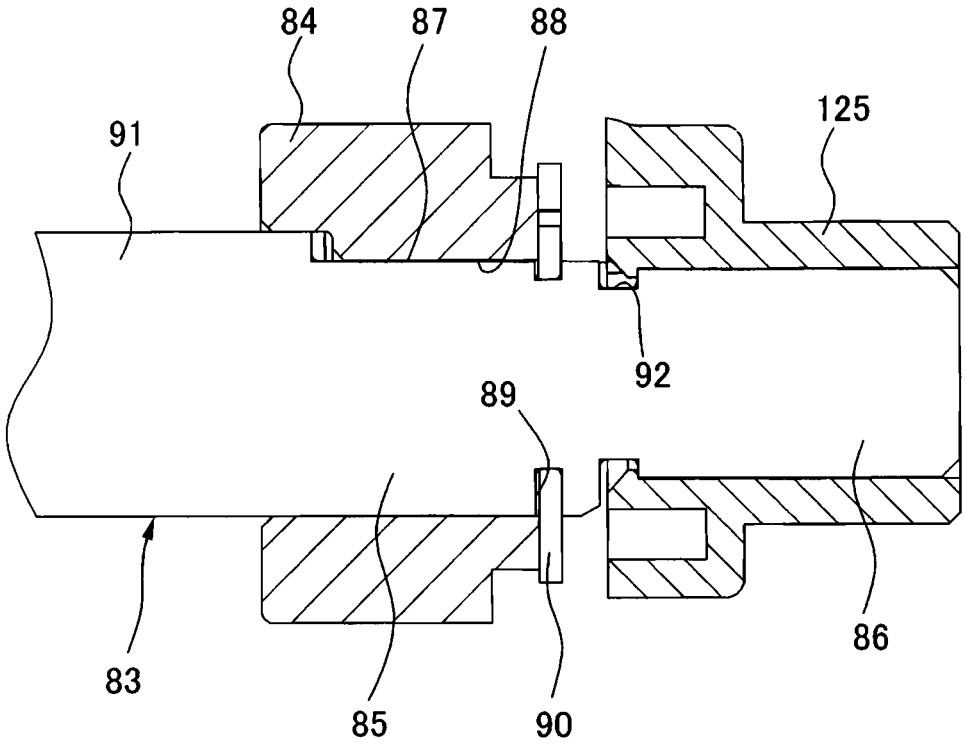
FIG. 10 is an enlarged sectional view of a left end portion of a developing gear.

As shown in FIGS. 9 and 10, the left end portion of the developing roller shaft 83 (one example of a first end portion) has at its outwardly protruding part from the left sidewall 73 a gear fixing part 85 to which a developing gear 84 is fixed and a small diameter part 86 that is formed at a left side of the gear fixing part 85 and becomes a leftmost end portion of the developing roller shaft 83.

As shown in FIG. 10, the gear fixing part 85 is processed into a sectional D shape having a planar surface 87 (one example of a D-cut part) on a part of a circumferential surface thereof. The developing gear 84 has a sectional D-shaped hole 88 corresponding to the shape of the gear fixing part 85, which is penetrated along a central axis line thereof. As the gear fixing part 85 is inserted into the D-shaped hole 88, the developing gear 84 is attached to the developing roller shaft 83 so that the developing gear cannot be relatively rotated. In addition, the gear fixing part 85 is formed at a left side of the planar surface 87 with a gear fixing recess 89 over a circumferentially overall region thereof. A separation preventing member 90 is fixed to a left end face of the developing gear 84. As the separation preventing member 90 is fitted in the gear fixing recess 89, the developing gear 84 is attached to the developing roller shaft 83 so that the developing gear cannot be relatively moved in the left-right direction.

The small diameter part 86 has a cylindrical shape whose diameter is smaller than a right side part 91 of the gear fixing part 85 of the developing roller shaft 83.

In addition, the developing roller shaft 83 is formed with a cover fixing recess 92 over its circumferentially overall region between the gear fixing part 85 and the small diameter part 86.

As shown in FIGS. 5 and 9, the right end portion of the developing roller shaft 83 (one example of a second end portion) has a circular peripheral surface having no stepped circumferential surface. In addition, the right end portion of the developing roller shaft 83 is attached with a developing electrode 93 for applying developing bias to the developing roller 18 at the right side of the right sidewall 74. The developing electrode 93 has a cylindrical part 158 that circumferentially surrounds the right end portion of the developing roller shaft 83. Although not shown, conductive grease is interposed between an inner surface of the cylindrical part 158 and the developing roller shaft 83.

(2-4) Supply Roller

As shown in FIG. 12, the supply roller 19 has a cylindrical supply roller main body 157 having an axis line extending in the left-right direction as a center and a supply roller shaft 156 that is inserted into the supply roller main body 157 along a central axis line thereof. A right end portion of the supply roller shaft 156 is attached with a supply electrode 94 for applying supply bias to the supply roller 19 at the right side of the right sidewall 74.

(2-5) Mounting Operation of Supply Roller

Next, a mounting operation of the supply roller will be described with reference to FIGS. 11 and 12.

When mounting the supply roller 19 to the housing 13 of the developing cartridge 13, the supply roller 19 is first disposed at the back side of the housing 13. At this state, both end portions of the supply roller shaft 156 (refer to FIG. 12) face the first shaft introducing parts 80 from the back side, respectively.

Then, the supply roller 19 is moved forward and both end portions of the supply roller shaft 156 face the rear end portions of the second shaft introducing parts 81 through the first shaft introducing parts 80 and the first shaft insertion through-holes 79.

Then, the supply roller 19 is obliquely moved downward and forward along the second shaft introducing parts 81. At this time, due to the inclination of the second shaft introducing parts 81 with respect to the line L, the supply roller 19 is moved toward the second shaft insertion through-holes 153 while depicting a trace of upwardly avoiding the ridge 152 positioned below the supply roller.

Then, both end portions of the supply roller shaft 156 enter the opened parts 155 of the supply bearing members 154. Thereby, the mounting of the supply roller 19 to the developing cartridge 7 is completed.

(2-6) First Gear Cover

Figure 8:
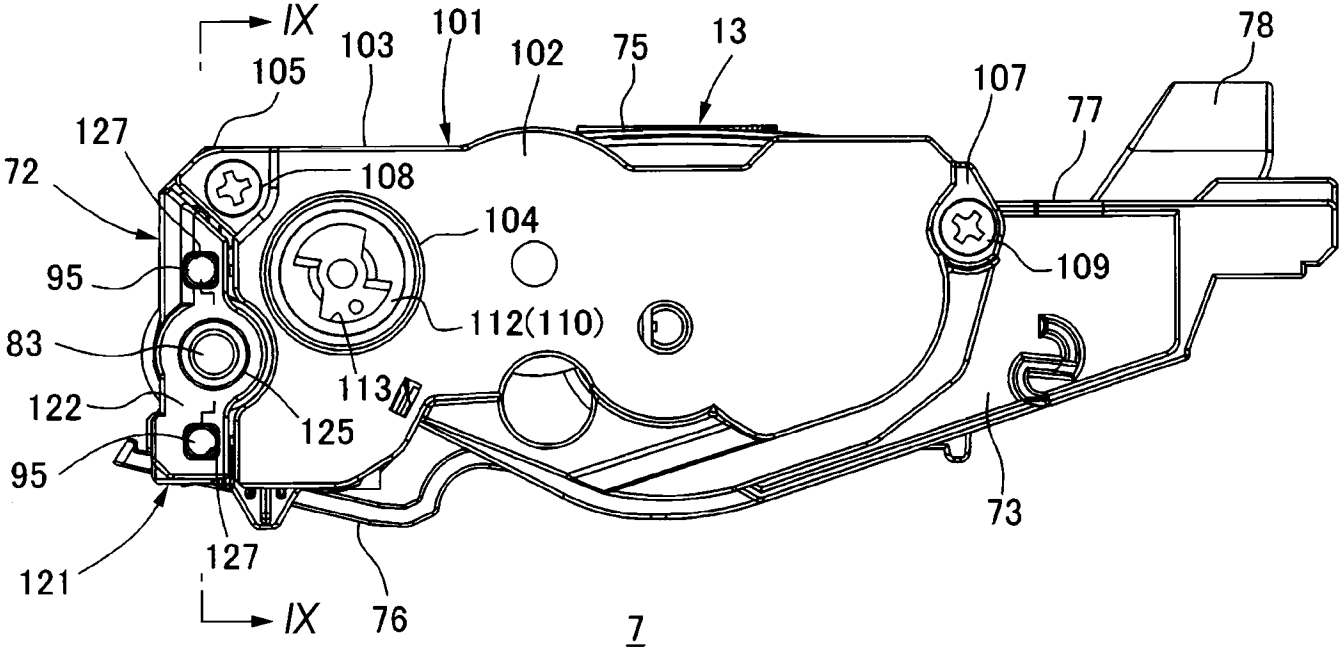
FIG. 8 is a left side view of the developing cartridge shown in FIG. 2.

A first gear cover 101 is provided on an outer side of the left sidewall 73 of the housing 13. As shown in FIG. 8, the first gear cover 101 has integrally a main body part 102 that extends forward and backward along the left sidewall 73 and a peripheral wall part 103 that extends to the left sidewall 74 from upper, front and lower end edges of the main body part 102.

The main body part 102 is formed at its rear end portion with a cylindrical coupling receiving part 104 that protrudes leftward. In addition, the rear end portion of the main body part 102 is formed with a back side screw insertion penetration part 105 (one example of a contact part) that is one-step dented at the right side at a back-upper part of the coupling receiving part 104.

The main body part 102 is formed at is front end portion with a front side screw insertion penetration part 107 that is one-step dented at the right side.

The first gear cover 101 is attached to the left sidewall 73 by screws 108, 109 that are respectively inserted into the back side screw insertion penetration part 105 and the front side screw insertion penetration part 107.

(2-7) Gear Train

A gear train including an input gear 110 (one example of a transmission gear) is arranged between the left sidewall 73 and the first gear cover 101.

The input gear 110 has a coupling part 112 that is received in the coupling receiving part 104 of the first gear cover 101. A left side end face of the coupling part 112 is formed with a connection recess portion 113. When the developing cartridge 7 (process cartridge 5) is mounted in the body casing 2 (refer to FIG. 2), a driving output member (not shown) provided in the body casing 2 is inserted in the connection recess portion 113. Driving force for rotating the developing roller 18 and the like is input to the input gear 110 from the driving output member. In addition, although not shown, the input gear 110 has a gear part having gear teeth formed on a circumferential surface thereof in the first gear cover 101. The gear teeth of the gear part are engaged with the developing gear 84. Thereby, when the driving force is input to the input gear 110, the driving force is transmitted from the input gear 110 to the developing gear 84, so that the developing roller 18 is rotated together with the developing gear 84.

(2-8) Second Gear Cover

Figure 6:
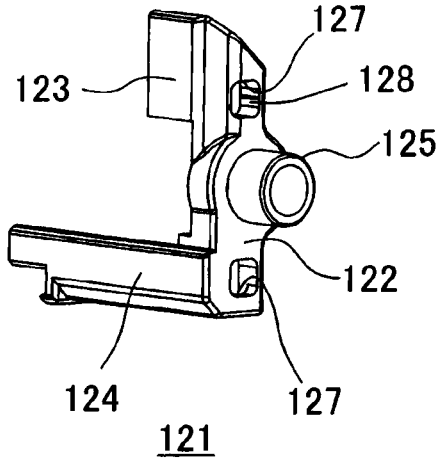
FIG. 6 is a perspective view of a second gear cover.
Figure 7:
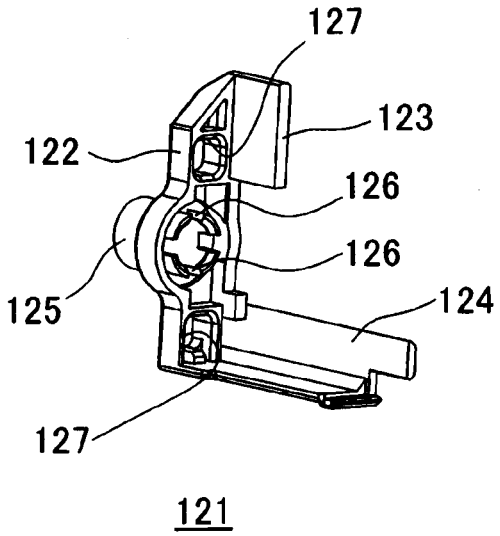
FIG. 7 is a perspective view of the second gear cover shown in FIG. 6 seen from the opposite side.

A second gear cover 121 is provided at a back side of the first gear cover 101 on the outer side of the left sidewall 73 of the housing 13 side by side with the first gear cover 101. As shown in FIGS. 6 and 7, the second gear cover 121 integrally includes a main body part 122, an upper extension 123 and a toner accommodating part 124 (one example of a developer accommodating part). The main body part 122, which has a substantially rectangular shape, is vertically long when seen from the side face. The upper extension 123, which has a rectangular plate shape, extends rightward from an upper part of a rear end edge of the main body part 122. The toner accommodating part 124, which has a L-shaped section, extends rightward from a lower part of the rear end edge of the main body part 122 and a lower end edge thereof.

A longitudinally central portion of the main body part 122 is formed with a cylindrical shaft insertion part 125 that protrudes leftward. A hollow portion of the shaft insertion part 125 communicates inner and outer sides of the main body part 122. An inner surface of the shaft insertion part 125 is formed with a plurality of protruding engagement claws 126 having a triangular section.

In addition, the main body part 122 is formed with boss insertion holes 127 having a substantially square shape above and below the shaft insertion part 125. A relative position relation between the upper boss insertion hole 127 and the shaft insertion part 125 is substantially the same as a relative position relation between the first shaft insertion through-hole 79 and the upper boss 95. In addition, a relative position relation between the lower boss insertion hole 127 and the shaft insertion part 125 is substantially the same as the relative position relation between the first shaft insertion through-hole 79 and the upper boss 95. Additionally, the upper boss insertion hole 127 is formed at a front side of an inner surface thereof with a ridge-type projection 128 that protrudes backward and extends leftward and rightward.

The small diameter part 86 of the developing roller shaft 83 inserted into the first shaft insertion through-holes 79 is inserted into the shaft insertion part 125 and the bosses 95 protruding from the left sidewall 73 of the housing 13 are inserted into the respective boss insertion holes 126, so that the second gear cover 121 is attached to the left sidewall 73 at a state that the second gear cover is positioned in a rotational direction having the developing roller shaft 83 as a center. The engagement claws 126 of the shaft insertion part 125 enter the cover fixing recess 92 of the developing roller shaft 83, so that the second gear cover 121 is attached to the left sidewall 73 at a state in which the second gear cover is positioned in the left-right direction conforming to the developing roller shaft 83.

At the state in which the second gear cover 121 is attached to the left sidewall 73, the main body part 122 is opposed to the developing gear 84 from the left side and covers the developing gear 84 from the left side. In addition, the toner accommodating part 124 is opposed to the left lower end portion of the opening 72 of the housing 13 from the back side. Furthermore, a head of the screw 108 inserted into the back side screw insertion penetration part 105 is arranged at the right side of the outer surface of the main body part 122.

As described above, the developing roller shaft 83 is arranged along the central axis line of the developing roller main body 82 and protrudes from both axial end portions of the developing roller main body 82. The left end portion of the developing roller shaft 83 has the small diameter part 86 having an outer diameter smaller than the right end portions thereof. In addition, the developing gear 84 is attached to the left end portion so that the developing gear cannot be relatively rotated.

As the developing gear 84 is fixed to the left end portion of the developing roller shaft 83, the weight of the developing gear 84 is added to the left end portion. However, the left end portion has the small diameter part 86 so that the increase in weight due to the fixing of the developing gear 84 is offset. Accordingly, it is possible to prevent the center of the developing roller shaft 83 from being inclined toward the left side of the developing roller shaft 83 due to the increase in weight resulting from the fixing of the developing gear. As a result, it is possible to stably rotate the developing roller 18 over the left-right direction.

In addition, the small diameter part 86 is formed at the side of the left end portion of the developing roller shaft 83 further outward than the part to which the developing gear 84 is attached. Thereby, it is possible to attach the developing gear 84 to the part of the developing roller shaft 83, which has a diameter larger than the small diameter part 86. Accordingly, it is possible to stably attach the developing gear 84 to the developing roller shaft 83.

In addition, the part of the developing roller shaft 84 to which the developing gear 84 is attached is formed with the gear fixing part 85 having a D-shaped section whose circumferential surface is partially notched. Thereby, it is possible to attach the developing gear 84 to the developing roller shaft 83 with a simple configuration so that the developing gear cannot be relatively rotated.

Additionally, the developing electrode 93 is attached to the right end portion of the developing roller shaft 83. The developing bias is applied to the developing electrode 93. Since the right end portion of the developing roller shaft 83 has a diameter larger than the small diameter part 86 of the left end portion, it is possible to increase a contact area between the developing electrode 93 and the developing roller shaft 83, compared to a configuration in which the developing electrode 93 is attached to the small diameter part 86. Accordingly, it is possible to improve transfer efficiency of the developing bias, which is applied to the developing electrode 93, to the developing roller shaft 83.

Also, the right end portion of the developing roller shaft 83 is circumferentially surrounded by the cylindrical part 158 of the developing electrode 93. The conductive grease is interposed between the developing roller shaft 83 and the cylindrical part 158. Thereby, the developing roller shaft 84 and the cylindrical part 158 contact each other through the grease without a gap. Therefore, it is possible to further improve the transfer efficiency of the developing bias, which is applied to the developing electrode 93, to the developing roller shaft 83.

In addition, the circumferential surface of the right end portion of the developing roller shaft 83 has the circular peripheral surface having no stepped circumferential surface. Thereby, when the developing electrode 93 is separated from the developing roller shaft 83 in recycling the developing roller, for example, it is possible to simply remove the grease attached to the circumferential surface of the right end portion of the developing roller shaft 83.

Further, since a special processing technique is not necessary so as to form the right end portion of the developing roller shaft 83, it is possible to reduce the processing cost of the developing roller shaft 83.

In addition, the supply roller shaft 156 is arranged along the central axis line of the supply roller main body 157 and protrudes from both end portions of the left-right direction of the supply roller main body 157. The developing roller shaft 83 is inserted into the first shaft insertion through-holes 79 formed on both sidewalls 73, 74 of the housing 13 and thus supported to both sidewalls 73, 74. Also, the supply roller shaft 156 is inserted into the second shaft insertion through-holes 153 formed on both sidewalls 73, 74 of the housing 13 and thus supported to both sidewalls 73, 74. The first shaft insertion through-holes 79 and the second shaft insertion through-holes 153 communicate with each other by the second shaft introducing parts 81 that are penetrated into both sidewalls 73, 74 in a thickness direction. The supply roller shaft 156 passes to the second shaft introducing parts 81 and is arranged in the second shaft insertion through-holes 153.

The second shaft introducing part 81 is inclined toward one side (upper side) of the direction orthogonal to the line L connecting the center of the first shaft insertion through-hole 79 and the center of the second shaft insertion through-hole 153. Thereby, it is possible to prevent the ridge 152, which upwardly protrudes from the lower side of the second shaft introducing part 81, from contacting the supply roller main body 157 in mounting the supply roller 19. As a result, it is possible to prevent the supply roller main body 158 from being damaged.

In addition, the drum cartridge 6 has the roller shaft receiving part 48 that guides the left and right end portions of the developing roller shaft 83 in attaching and detaching the developing cartridge 7. The left and right end portions are guided along the roller shaft receiving part 48, so that it is possible to securely mount the developing cartridge 7 to the drum cartridge 6. Also, since the right end portion of the developing roller shaft 83 has a diameter larger than the small diameter part 86 formed at the left end portion, it is possible to increase the contact area between the developing roller shaft 83 and the drum cartridge 6, compared to a configuration in which the small diameter part 86 is guided along the roller shaft receiving part 48. Accordingly, it is possible to stably guide the developing cartridge 7 to the drum cartridge 6.

Although the illustrative embodiment of the invention has been described, the invention can be implemented into other embodiments.

For example, in the above illustrative embodiment, the black-white printer that is an example of the image forming apparatus is exemplified. However, a color printer may be adopted as an example of the image forming apparatus. In this case, the invention can be applied to a developing cartridge that is detachably mounted to the color printer.

What is claimed is:

1. A developing cartridge comprising:

a developing roller having a rotational axis, the developing roller including:

a developing roller main body having a first end and a second end opposite to the first end;

a first protrusion protruding outwardly from the first end of the developing roller main body along the rotational axis, a second protrusion protruding outwardly from the second end of the developing roller main body along the rotational axis, and a developing gear having a D-shaped hole, wherein the first protrusion has a circular peripheral surface having no stepped circumferential surface; and wherein the second protrusion includes:

a small diameter part having a circular peripheral surface having a diameter smaller than a diameter of the first protrusion; and a D-cut part disposed between the developing roller main body and the small diameter part along the rotational axis, at least a portion of the D-cut part being inserted into the D-shaped hole, a gear cover covering at least a portion of the developing gear, the gear cover having an outwardly protruding insertion part through which the small diameter part of the second protrusion is inserted, wherein the insertion part protrudes outwardly along the rotational axis.

2. The developing cartridge according to claim 1, further comprising:

a recess disposed between the D-cut part and the small diameter part along the rotational axis.

3. The developing cartridge according to claim 2, wherein the insertion part includes one or more engagement claws formed on an inner surface of the insertion part;

wherein the one or more engagement claws engages the recess.

4. The developing cartridge according to claim 1, wherein the gear cover further includes a main body part covering at least a portion of the developing gear, and wherein the insertion part protrudes outwardly from the main body part.

5. The developing cartridge according to claim 1, wherein the gear cover further includes a main body part covering at least a portion of the developing gear, and wherein the insertion part protrudes outwardly from the main body part along the rotational axis.

6. A developing cartridge configured to be insertable into and removable from an image forming device, the developing cartridge comprising:

a developing roller having a rotational axis, the developing roller including:

a developing roller main body having a first end and a second end opposite to the first end;

a first protrusion protruding outwardly from the first end of the developing roller main body along the rotational axis, a second protrusion protruding outwardly from the second end of the developing roller main body along the rotational axis, and a developing gear having a D-shaped hole, wherein the first protrusion has a circular peripheral surface having no stepped circumferential surface; and wherein the second protrusion includes:

a small diameter part having a circular peripheral surface having a diameter smaller than a diameter of the first protrusion; and a D-cut part disposed between the developing roller main body and the small diameter part along the rotational axis, at least a portion of the D-cut part being inserted into the D-shaped hole, a gear cover covering at least a portion of the developing gear, the gear cover having an outwardly protruding insertion part through which the small diameter part of the second protrusion is inserted.

7. The developing cartridge according to claim 6, further comprising:

a recess disposed between the D-cut part and the small diameter part along the rotational axis.

8. The developing cartridge according to claim 7, wherein the insertion part includes one or more engagement claws formed on an inner surface of the insertion part;

wherein the one or more engagement claws engages the recess.

9. The developing cartridge according to claim 6, wherein the gear cover further includes a main body part covering at least a portion of the developing gear, and wherein the insertion part protrudes outwardly from the main body part.

10. The developing cartridge according to claim 6, wherein the insertion part protrudes outwardly along the rotational axis.

11. The developing cartridge according to claim 10, wherein the gear cover further includes a main body part covering at least a portion of the developing gear, and wherein the insertion part protrudes outwardly from the main body part along the rotational axis.

12. A developing cartridge configured to be insertable into and removable from an image forming device, the developing cartridge comprising:

a developing roller configured to rotate about a rotational axis based on a driving force received from the image forming device, the developing roller including:

a developing roller main body having a first end and a second end opposite to the first end;

a first protrusion protruding outwardly from the first end of the developing roller main body along the rotational axis, a second protrusion protruding outwardly from the second end of the developing roller main body along the rotational axis, and a developing gear having a D-shaped hole, the developing gear configured to mesh with a transmission gear to receive the driving force from the image forming device, wherein the first protrusion has a circular peripheral surface having no stepped circumferential surface; and wherein the second protrusion includes:

a small diameter part having a circular peripheral surface having a diameter smaller than a diameter of the first protrusion; and a D-cut part disposed between the developing roller main body and the small diameter part along the rotational axis, at least a portion of the D-cut part being inserted into the D-shaped hole, a gear cover covering at least a portion of the developing gear, the gear cover having an outwardly protruding insertion part through which the small diameter part of the second protrusion is inserted.

13. The developing cartridge according to claim 12, further comprising:

a recess disposed between the D-cut part and the small diameter part along the rotational axis.

14. The developing cartridge according to claim 13, wherein the insertion part includes one or more engagement claws formed on an inner surface of the insertion part;

wherein the one or more engagement claws engages the recess.

15. The developing cartridge according to claim 12, wherein the gear cover further includes a main body part covering at least a portion of the developing gear, and wherein the insertion part protrudes outwardly from the main body part.

16. The developing cartridge according to claim 12, wherein the insertion part protrudes outwardly along the rotational axis.

17. The developing cartridge according to claim 16, wherein the gear cover further includes a main body part covering at least a portion of the developing gear, and wherein the insertion part protrudes outwardly from the main body part along the rotational axis.

* * * * *